US005657651A

United States Patent [19]

Oh et al.

[11] Patent Number: 5,657,651

[45] Date of Patent: Aug. 19, 1997

[54] WASHING APPARATUS OF A FULLY AUTOMATIC WASHING MACHINE

[75] Inventors: Dong Yeop Oh; Gyu Sang Choe, both of Kyungki-do; Kyung Seop Hong, Inchon-Jikhalsi; Kyung Hwan Kim; Oh Hun Kwon, both of Seoul, all of Rep. of Korea

[73] Assignee: LG Electronics Inc., Seoul, Rep. of Korea

[21] Appl. No.: 579,427

[22] Filed: Dec. 27, 1995

[30] Foreign Application Priority Data

Nov. 7, 1995 [KR] Rep. of Korea ..... 40138/1995

[51] Int. Cl.[6] ..... D06F 13/06

[52] U.S. Cl. ..... 68/131; 68/156

[58] Field of Search ..... 68/53, 131, 132, 68/133, 134, 148, 152, 153, 155, 156

[56] References Cited

U.S. PATENT DOCUMENTS

| | | | |
|---|---|---|---|
| 912,107 | 2/1909 | Froese et al. | 68/156 |
| 2,776,558 | 1/1957 | Vang | 68/53 |
| 2,883,844 | 4/1959 | Gil et al. | 68/156 |

*Primary Examiner*—Philip R. Coe
*Attorney, Agent, or Firm*—Fish & Richardson P.C.

[57] ABSTRACT

A washing apparatus of a fully automatic washing machine incorporated with a washing course of dry-marked clothes includes a motor shaft installed to a motor mounted to an outer tub for being rotated by the driving of the motor, a driving member coupled with the motor shaft for reciprocally ascending and descending together with the rotational movement of the motor shaft, and a washing net joined to the driving member for being vibrated in up and down directions in accordance with the reciprocal ascending and descending movement of the driving member to preserve and clean the laundry indicated with the dry mark, in which the driving member is installed to the center of a washing blade and inserted with the washing net. Thus, the washing net housing with the laundry thereon is vibrated in up and down directions while the driving member reciprocally ascends and descends along with the driving of the motor. This minimizes a mechanical action such as warping or friction damaging the laundry, so that the laundry is preserved and, at the same time, the dry-marked clothes are effectively cleaned with main waterstream and slight fluctuation, thereby significantly improving the efficiency and reliability of the product.

5 Claims, 5 Drawing Sheets

PRIOR ART

WASHING APPARATUS OF A FULLY AUTOMATIC WASHING MACHINE

BACKGROUND OF THE INVENTION

1. Field of the Invention

The present invention relates to a washing apparatus of a fully automatic washing machine incorporated with a washing course for dry-marked clothes, and more particularly to a washing apparatus for efficiently cleaning clothes indicated with a dry mark in a fully automatic washing machine.

2. Description of the Prior Art

A full automatic washing machine capable of cleaning suits clothes indicated with a dry mark has recently been on the market as shown in FIG. 1, of which construction will be described below.

A washtub 10*a* is rotatably installed within an outer tub 1*a*, and a plurality of thruholes 12 are formed in an inner circumference of washtub 10*a*. A washing blade 6*a* is installed to a lower center of washtub 10*a* to be rotated clockwise and counter-clockwise during performing a washing operation by receiving power from a motor 2*a*. A washing net 11*a* formed of a flexible material is installed to an upper portion of washing blade 6*a* for preserving and cleaning the laundry indicated with the dry mark within washtub 10*a*.

Therefore, the dry-marked clothes are put on washing net 11*a* within washtub 10*a*, and washing blade 6*a* relatively larger than a conventional washing blade is rotated clockwise and counter-clockwise. By doing so, washing blade 6*a* is agitated to upwardly beat flexible washing net 11*a* for applying a slight warping in addition to a waterstream within the washtub 10*a* thereby cleaning the dry-marked clothes.

Meantime, in place of the above-described method for cleaning the dry-marked clothes, washing blade 6*a* is rotated clockwise or counter-clockwise for 20~30 seconds to agitate the washing water for dissolving a detergent, and the laundry is soaked into the water with the dissolved detergent during the remaining washing time to finish the washing course. Otherwise, the washing is performed via a typical wool course.

In the conventional fully automatic washing machine for cleaning dry-marked clothes, however, since the clothes must not be damaged during the washing operation, the cleaning mainly depends on the washing waterstream. Also, the washing machine is driven by the clockwise and counter-clockwise rotation of washing blade 6*a* to involve just a slight flow of water within washtub 10*a* and a powerless intensity in the washing waterstream, so that the washing does not degrade the reliability of the product.

SUMMARY OF THE INVENTION

The present invention is devised to solve the above-described problems. Accordingly, it is an object of the present invention to provide a washing apparatus of a fully automatic washing machine incorporated with a washing course of dry-marked clothes capable of efficiently cleaning clothes indicated with a dry mark mainly by a waterstream and by a slight fluctuation while minimizing a mechanical action which is damaging to the laundry due to the warping or friction when the clothes with a dry mark are cleaned in the fully automatic washing machine.

To achieve the above object of the present invention, there is provided a washing apparatus of a fully automatic washing machine incorporated with a washing course for dry-marked clothes, which includes a motor shaft installed to a motor mounted to an outer tub for being rotated by the driving of the motor, and a driving member coupled with the motor shaft for reciprocally ascending and descending together with the rotational movement of the motor shaft. In addition, a washing net is joined to the driving member for being vibrated in up and down directions in accordance with the reciprocal ascending and descending movement of the driving member to preserve and clean the laundry indicated with the dry mark.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Hereinbelow, one embodiment of the present invention will be described in detail with reference to FIGS. 4 to 6.

Figure 4:
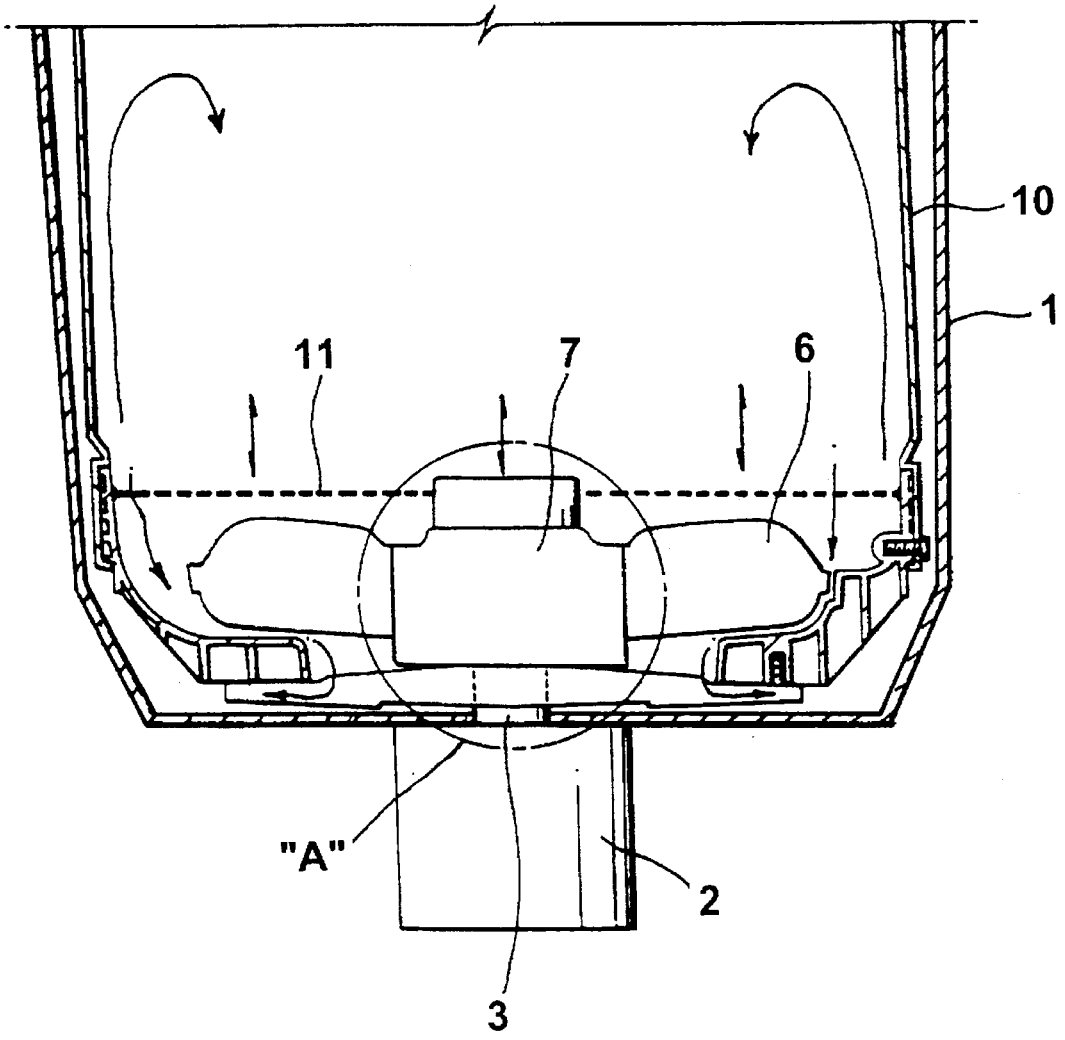
FIG. 4 is a vertical section view showing a washing machine according to the present invention.
Figure 5A:
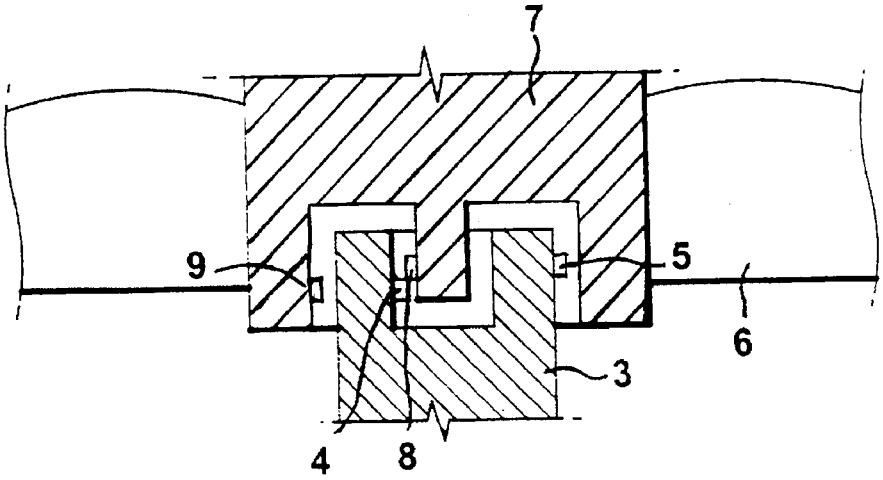
FIGS. 5A and 5B are a vertical section view and a horizontal section view showing a portion A of FIG. 4, respectively.
Figure 5B:
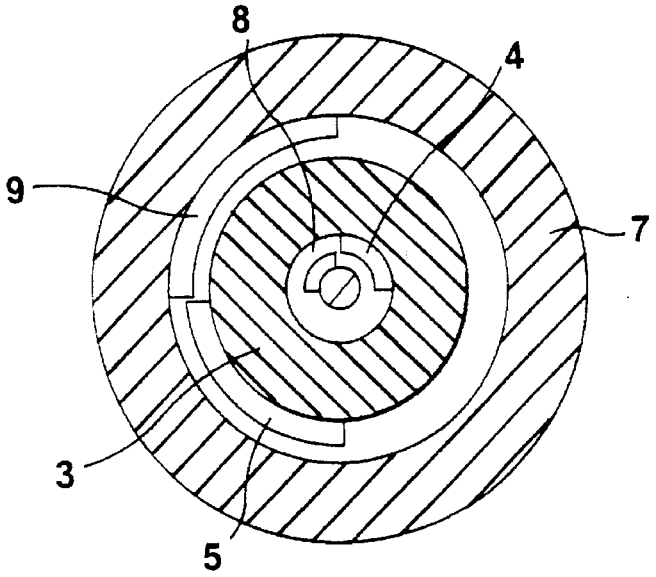

FIG. 4 is a vertical section view showing a washing machine according to the present invention, FIGS. 5A and 5B are a vertical section view and a horizontal section view showing a portion A of FIG. 4, respectively. FIG. 6 is a graph representation for comparing variation of cleanness with respect to the time when the waterstream and fluctuating waterstream are produced according to the present invention. Here, a motor shaft 3 rotated by the driving of a motor 2 is installed to an upper portion of motor 2 which is mounted to a bottom center of an outer tub 1 of the full automatic washing machine for producing power in one direction to attain acceleration and deceleration operations. First and second ratchets 4 and 5 are formed to inner and outer circumferences of an upper portion of motor shaft 3, respectively.

A driving member 7 having an amplitude of 1~100 mm and a rpm of 30~1,800 reciprocates in up and down directions together with the rotational movement of motor shaft 3 and is installed on the center of a washing blade 6 coupled with an upper end of motor shaft 3. Third and fourth ratchets 8 and 9 selectively fitted with first and second ratchets 4 and 5 by the driving of motor 2 are formed to an inner center and an outer circumference of driving member 7, respectively. A washing net 11 formed of a flexible material is inserted to driving member 7 within a washtub 10 for being vibrated upwardly and downwardly along with the reciprocal ascending and descending movement of driving member 7 to clean and preserve the laundry indicated with a dry mark.

As illustrated in FIGS. 4 and 5, in the washing apparatus according to the present invention constructed as above, motor 2 mounted to the bottom center of outer tub 1 primarily produces power in one direction during washing the dry-marked clothes. By doing so, motor shaft 3 installed onto motor 2 is rotated to rotate driving member 7 which is installed to the center of washing blade 6 coupled with the upper end of motor shaft 3 to be operated with an amplitude of 1~100 mm and an rpm of 30~1,800 under the state as shown in FIG. 5B. Here, when second ratchet 4 formed to the inner circumference of the upper portion of motor shaft 3 is fitted with third ratchet 8 formed to the inner center of driving member 7 as shown in FIG. 5A, driving member 7 ascends. Additionally, first and third ratchets 4 and 8 are separated from each other at a point of completing the ascending of driving member 7. Simultaneously, second ratchet 5 formed to the outer circumference of motor shaft 3 is fitted with fourth ratchet 9 formed to the inner circumference of driving member 7, thereby descending driving member 7.

At a point of completing the descending of driving member 7, second and fourth ratchets 5 and 9 are separated from each other, and at the same time, the above-described process is repeated. Therefore, driving member 7 reciprocally ascends or descends together with the rotation of washing blade 6 in one direction, so that washing net 11 inserted on driving member 7 while housing the laundry thereon is vibrated in the up and down directions along with the reciprocal ascending and descending movement of driving member 7. Consequently, the dry-marked laundry is beaten without being damaged to preserve and efficiently clean the dry-marked clothes.

Furthermore, substantially abundant washing water is dropped onto the clothes put on washing net 11 from the upper portion within washtub 10 to provide an effect of laundering with hands. Especially, since the dry-marked clothes should not be warped or rubbed by friction in order to prevent the clothes from being damaged, the washing operation cannot be performed via the conventional technique of rotating the washing blade clockwise or counter-clockwise to directly impose a mechanical energy to the laundry. Thus, washing net 11 is inserted to driving member 7 at the center of washing blade 6 to be driven up and down with a frequency which is the same as the rpm of washing blade 6 or slightly accelerated or decelerated, thereby fluctuating the laundry.

At this time, washing net 11 which directly fluctuates the clothes is formed of a flexible material such as a plastic.

Figure 3:
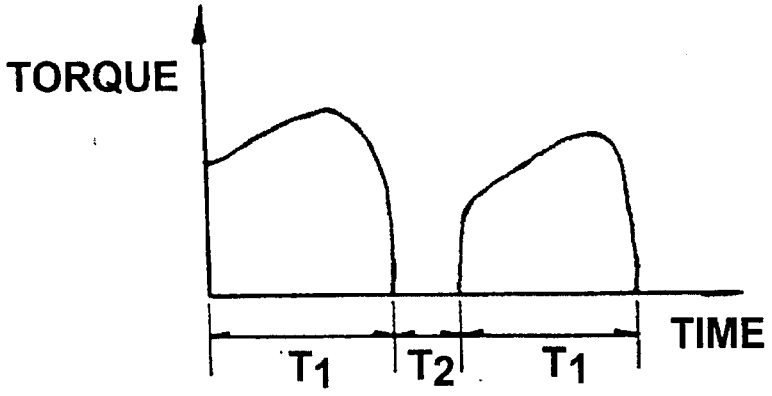
(PRIOR ART) FIG. 3
FIG. 3 is a graph representation plotting a relation between the time and torque during rotation of the motor clockwise and counter-clockwise in a washing operation of the conventional washing machine.

Also, since motor 2 is not rotated clockwise and counter-clockwise to restrain the rise in temperature of motor 2 over the conventional washing machine operated as illustrated in FIG. 3, the durability of motor 2 can be lengthened.

Figure 1:
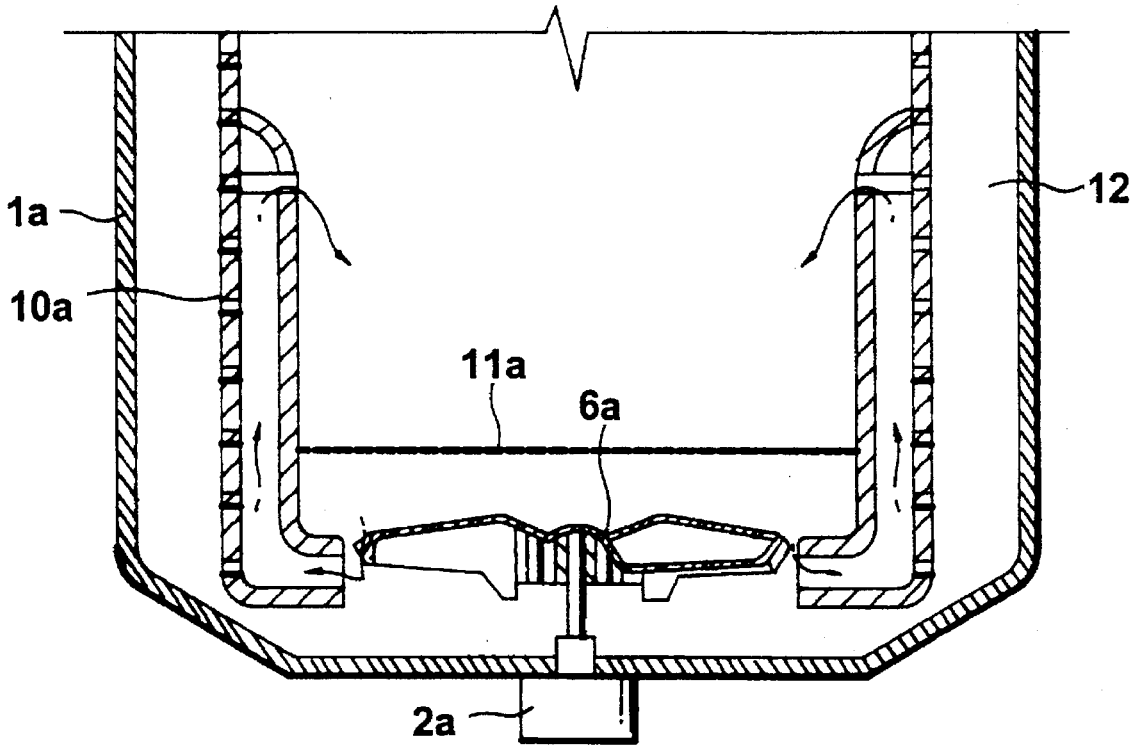
FIG. 1 is a vertical section view showing a conventional full automatic washing machine incorporated with a washing course of dry-marked clothes.
Figure 2A:
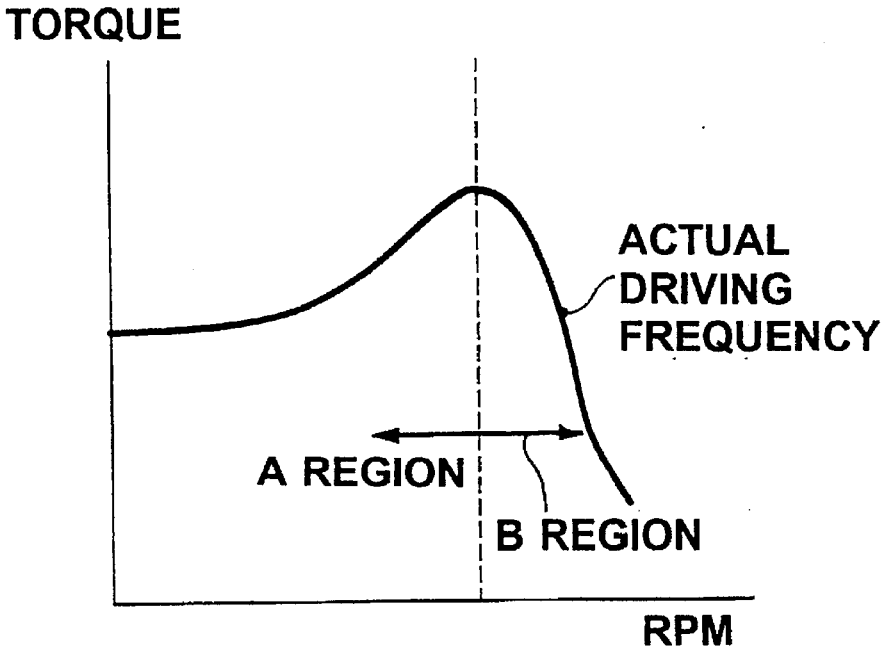
(PRIOR ART) FIG. 2a
FIGS. 2A and 2B are graph representations respectively comparing the relation between torque and current with respect the rpm in the motor of the conventional washing machine.
Figure 2B:
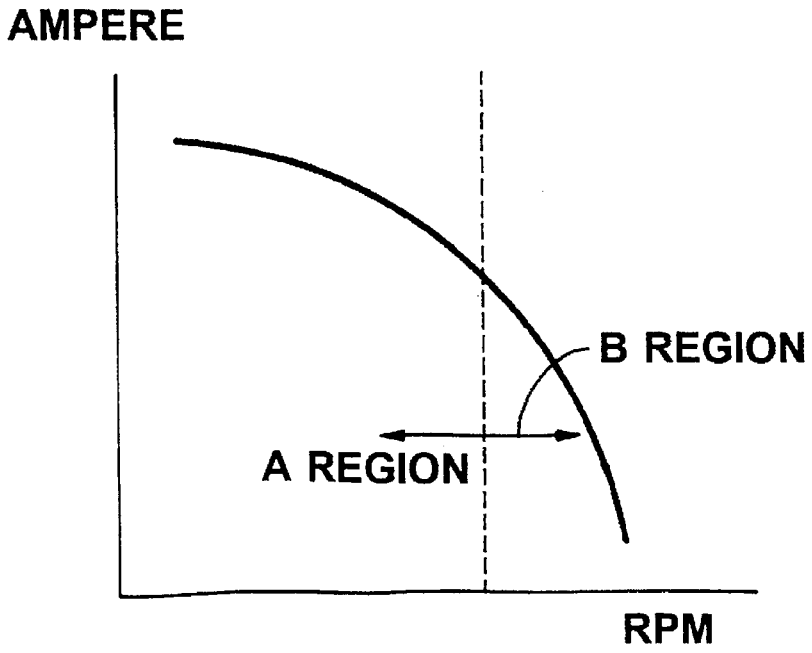
(PRIOR ART) FIG. 2b

In other words, as shown in FIGS. 2A and 2B, the conventional washing machine raises the temperature of motor 2 because the torque and current are increased at the initial time of the clockwise and counter-clockwise rotation. At this time, a portion A has an efficiency of below 20% and a portion B has an efficiency of approximately 40–50%, in which the section of the lower efficiency should be repeated every time until reaching portion B enabling the normal rotation. Therefore, the washing machine according to the present invention can be driven with the higher efficiency by rotation only in one direction. Moreover, the motor is driven only in portion B letting alone portion A which is difficult to be controlled, so that the driving efficiency can be significantly improved.

In the washing machine according to the present invention, the fluctuating waterstream and a drop waterstream with constant flow are simultaneously provided. Consequently, washing net 11 is vibrated in up and down directions while the constant flow permeates the laundry to cause a higher level of cleanness during cleaning the dry-marked clothes without damaging the clothes, as shown in FIG. 6.

Figure 6:
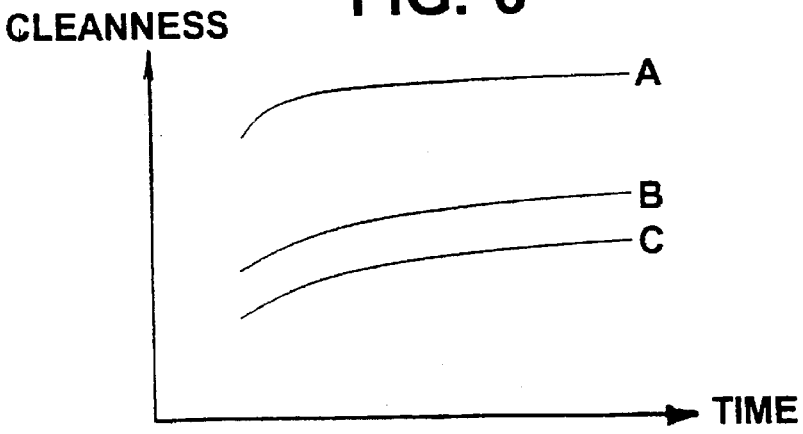
FIG. 6 is a graph representation for comparing variation of cleanness with respect to the time when the waterstream and fluctuating waterstream are produced according to the present invention.

For a reference, FIG. 6 is the graph representation for comparing the variation in the cleanness with respect to the time when the waterstream and fluctuating waterstream are produced according to the present invention, in which a curve A plots the cleanness of the laundry when only the washing waterstream exists, a curve B plots that when fluctuation is solely applied thereto, and a curve C plots that when the washing waterstream and fluctuation are simultaneously applied. Here, curves A and B may be varied in accordance with the frequency and amplitude of driving member 7 and the amount of the drop waterstream.

Figure 7:
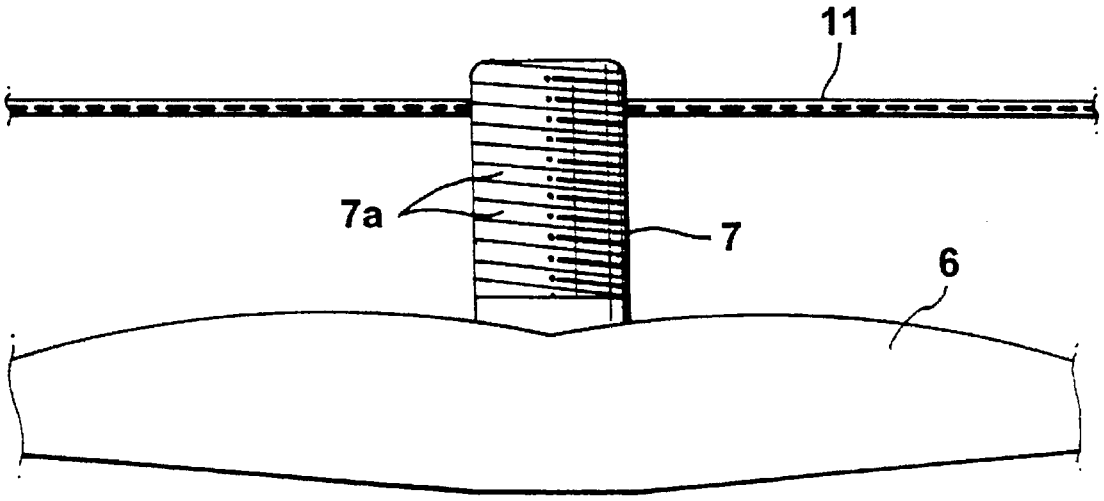
FIG. 7 is a vertical section view showing another embodiment of the present invention.

As another embodiment of the washing machine according to the present invention as shown in FIG. 7, a spiral slot 7*a* is formed along an outer circumference of driving member 7 on the center of washing blade 6 coupled with motor shaft 3, so that washing net 11 is joined to be attached and detected. Thus, washing net 11 is confined as one portion of washtub 10 to reciprocate up and down directions together with the clockwise and counter-clockwise rotation of washing blade 6, thereby performing the washing operation.

That is, the washing can be efficiently carried out by the drop waterstream from the upper portion of washtub 10 when washing net 11 ascends during the clockwise rotation, the constant waterstream permeating the laundry when washing net 11 forcibly ascends, and a fluctuating waterstream which vibrates at the moment of the clockwise and counter-clockwise rotation.

On the other hand, as still another embodiment of the washing machine according to the present invention, the rpm of motor 2 may be increased/decreased to vary the flow amount of water dropping upon the laundry for moving the washing waterstream in the up and down directions to add a slight warping. More specifically, the clothes are further swollen toward washing net 11 when the amount of dropping flow is heavy, whereas the clothes are floated upward when the amount of the dropping flow is trivial. Therefore, by properly adjusting the amount of the dropping flow, the clothes are beaten just by the waterstream to perform the washing.

Also, in the midst of the clockwise and counter-clockwise rotation by rotating motor 2 clockwise and counter-clockwise, i.e., when motor 2 is stopped, there is no dropping waterstream to permit the laundry to float. Accordingly, the warping brought at this time can be utilized to perform the washing.

In the washing apparatus of the fully automatic washing machine incorporated with the washing course of dry-marked clothes according to the present invention as described above, driving member 7 is installed on the center of washing blade 6 of the full automatic washing machine, and washing net 11 is inserted to driving member 7. Then, driving member 7 reciprocally ascends and descends in accordance with the driving of motor 2 when cleaning the dry-marked clothes. Simultaneously, washing net 11 housing the laundry thereon vibrates up and down directions. As a result, a mechanical action such as the warping or friction which damages the laundry is minimized to preserve the laundry while the dry-marked clothes can be effectively cleaned with the main waterstream and slight fluctuation, thereby significantly improving efficiency and reliability of the product.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A washing apparatus of a fully automatic washing machine, the washing apparatus comprising:

an inner tub;

an outer tub;

a motor mounted to the outer tub;

a rotatable motor shaft installed in and extending from the motor, the rotatable motor shaft being connected to the inner tub and configured to rotate the inner tub;

a driving member coupled with said motor shaft for reciprocally ascending and descending together with the rotational movement of said motor shaft;

a washing net joined to said driving member for being vibrated in up and down directions in accordance with the reciprocal ascending and descending movement of said driving member;

first and second ratchets respectively formed to an inner circumference and an outer circumference of an upper portion of said motor shaft; and third and fourth ratchets selectively fitted with said first and second ratchets by driving of said motor.

2. The washing apparatus of claim 1, wherein said motor is rotated in one direction to initiate the reciprocal ascending and descending movement of said washing net.

3. The washing apparatus of claim 1, wherein a spiral slot is formed along an outer circumference of said driving member to be attachable and detachably joined with said washing net.

4. The washing apparatus of claim 1, wherein said driving member is inserted into a center of a washing blade, the driving member being configured to reciprocally ascend and descend with an amplitude of 1~100 mm and to rotate with a rpm of 30~1,800.

5. The washing apparatus of claim 1, wherein said washing net is formed of a flexible material.

* * * * *